US005581153A

United States Patent [19]

Bridges

[11] Patent Number: 5,581,153

[45] Date of Patent: Dec. 3, 1996

[54] ELECTRON BEAM TUBE HAVING RESONANT CAVITY CIRCUIT WITH SELECTIVELY ADJUSTABLE COUPLING ARRANGEMENT

[75] Inventor: Mark Bridges, Chelmsford, United Kingdom

[73] Assignee: EEV Limited, Chelmsford, United Kingdom

[21] Appl. No.: 224,494

[22] Filed: Apr. 7, 1994

[30] Foreign Application Priority Data

Apr. 13, 1993 [GB] United Kingdom ..... 9307612

[51] Int. Cl.[6] ..... H01J 23/20

[52] U.S. Cl. ..... 315/5; 315/5.390; 330/45; 333/230

[58] Field of Search ..... 315/4, 5, 5.39, 315/5.53; 330/44, 45; 333/230, 227

[56] References Cited

U.S. PATENT DOCUMENTS

| | | | |
|---|---|---|---|
| 2,372,228 | 3/1945 | Schelkunoff | 333/227 |
| 2,511,120 | 6/1950 | Mueller | 330/45 X |
| 2,610,307 | 9/1952 | Hansen et al. | 315/5.53 |
| 3,305,799 | 2/1967 | Levin | 315/5.39 X |
| 5,239,272 | 8/1993 | Bohlen et al. | 333/230 X |

FOREIGN PATENT DOCUMENTS

| | | |
|---|---|---|
| 828078 | 2/1960 | United Kingdom . |
| 1130207 | 10/1968 | United Kingdom . |
| 2244854 | 12/1991 | United Kingdom . |

*Primary Examiner*—Benny T. Lee
*Attorney, Agent, or Firm*—Spencer & Frank

[57] ABSTRACT

An electron beam tube arrangement in an inductive output tetrode. The arrangement comprises a resonant cavity circuit having two cavities, and includes an element for coupling high frequency energy between the two cavities. The coupling element includes a coupling dome projecting into one of the two cavities from a wall thereof. The coupling dome has a base portion which is adapted to be connected to a dome completion member selected from a set comprising at least one dome completion member for adjusting a coupling level between the two cavities.

14 Claims, 5 Drawing Sheets

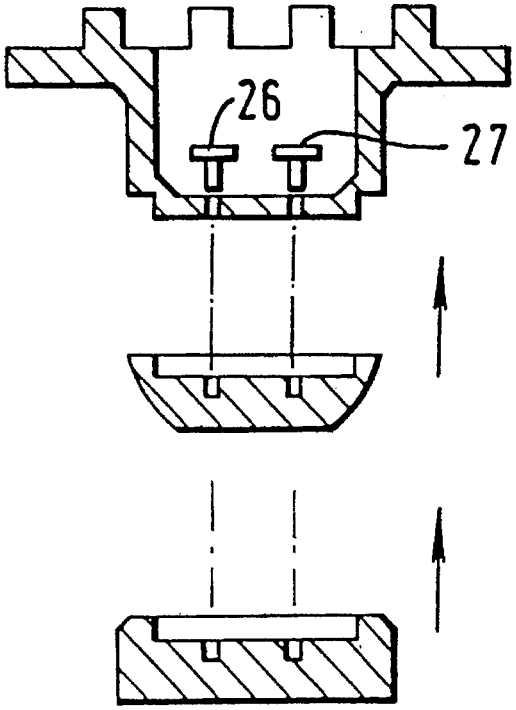
FIG. 4
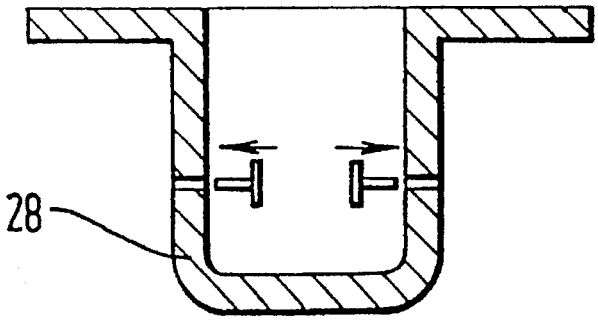
FIG. 5
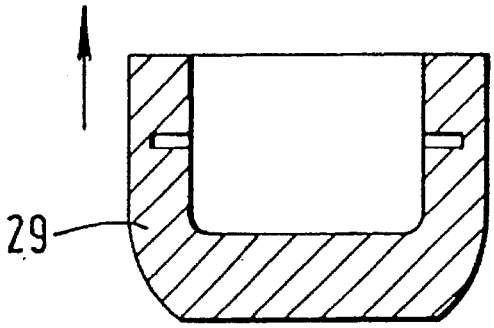

ELECTRON BEAM TUBE HAVING RESONANT CAVITY CIRCUIT WITH SELECTIVELY ADJUSTABLE COUPLING ARRANGEMENT

FIELD OF THE INVENTION

This invention relates to electron beam tube arrangements comprising resonant cavities, and more particularly, but not exclusively, to output resonant cavity circuits of such arrangements from which high frequency energy is extracted.

The present invention is particularly applicable to inductive output tetrode devices (hereinafter referred to as "IOT's") such as those referred to by the trade name Klystrode (registered trademark, Varian Associates Inc.).

BACKGROUND OF THE INVENTION

An IOT device includes an electron gun arranged to produce a linear electron beam and an input resonant cavity at which an r.f. signal to be amplified is applied to produce modulation of the beam at a grid of the electron gun. The resultant interaction between the r.f. energy and the electron beam causes amplification of the high frequency signal which is then extracted from an output resonant cavity circuit.

One problem faced by designers and operators of IOT devices is that the dimensions of the arrangement, particularly the resonator cavities included at the input and output parts of the device, must be precisely chosen for a particular band of operating frequencies. The resonant frequency of resonant cavities may be altered using tuning doors, or movable tuning plates, to change their volume. However coupling efficiency between primary and secondary resonant cavities may be adversely affected when operated at the extremes of the frequency band, even to the extent that it may be impracticable to use the device. In such cases, a second tube suitable for use over a different range of frequencies may be required.

The present invention arose from the particular consideration of the output cavity arrangement of IOT devices but it is also applicable to other electron beam tube arrangements in which coupling between resonant cavities is employed, such as, for example, klystrons.

SUMMARY OF THE INVENTION

According to the invention, there is provided an electron beam tube arrangement comprising: a resonant cavity circuit comprising two cavities, means for coupling high frequency energy between them, and a coupling dome projecting into one of the cavities from a wall thereof, the dome comprising a base portion adapted to be joined to a dome completion member of a set of one or more dome completion members, whereby coupling between the two cavities is adjustable depending on selection of the dome completion member.

By employing the invention, it is possible to provide efficient coupling over a wide range of operating frequencies by selecting different dome completion members as appropriate for use in co-operation with the base portion.

In one preferred embodiment of the invention, the coupling dome comprises a base portion which is used in conjunction with a selected one of a set of dome completion members to provide a variable dome configuration which may be assembled by a user of the equipment. The dome completion members may be of different thicknesses and diameters so as to essentially alter the configuration of the cavity in which they are located, hence changing inductance and capacitance within the cavity and thus affecting the coupling characteristics.

Thus, the use of the invention enables increased flexibility in operating characteristics to be achieved without the need to use a separate device. The extra parts required compared to a conventional arrangement are relatively small and easy to manufacture and do not add greatly to the total cost of the arrangement.

In one preferred embodiment of the invention, each dome completion member is joined to the base portion by co-operating screw thread arrangements giving a good electrical connection between them. In another arrangement, fixing means, such as screws, are located through the base portion and into a dome completion member.

In one preferred embodiment of the invention, the base portion is in a form of a closed cylinder on which the selected dome completion member is mounted. The cylinder may be of circular symmetry or some other configuration. For example it could have a square transverse section. In another embodiment the base portion is an open-ended cylinder, the dome completion member being attached to its inner or outer wall surface.

Preferably, the coupling dome is substantially circularly cylindrical although other configurations may be employed. For example, the dome may take the form of a block having square or rectangular faces. Advantageously, the base portion is removable from the wall. This enables different dome completion members to be easily removed and fitted.

Although in a preferred embodiment, the coupling dome is a base portion which must be used in conjunction with a dome completion member, in another embodiment of the invention, the base portion is itself capable of operating as a complete coupling dome. Thus, one arrangement in accordance with the invention may comprise a base portion and a single dome completion member, which is either selected for combination with the base portion or not depending on what operational performance is required. Of course, two or more completion members may be available for use with a base portion capable of acting as a complete coupling dome.

In one advantageous embodiment of the invention, coupling between the first and second cavities is achieved by a coupling arrangement which includes an electrically conductive member, such as a block, located within one of the cavities. The coupling dome may be arranged within the same cavity and aligned with the conductive block with a gap between them such that the end faces of the block and dome face one another. In such a configuration the coupling dome is particularly direct in its effect on coupling between the first and second cavities. The gap between the dome and conductive member may be altered by selecting different dome completion members.

The invention is particularly applicable to output resonant cavity circuits of electron beam devices such as IOT's and klystrons. However, it could also be implemented in other arrangements involving coupling between resonant cavities, such as at the input resonant cavity circuit in those arrangements which use two input cavities.

BRIEF DESCRIPTION OF DRAWINGS

Some ways in which the invention may be performed are now described by way of example with reference to the accompanying drawings in which:

FIG. 4 schematically illustrates a coupling dome including alternative dome completion members having fastening means different from those in FIG. 2;

FIG. 5 schematically illustrates a coupling dome in which the base member itself is capable of acting as a complete coupling dome.

DETAILED DESCRIPTION OF THE PREFERRED EMBODIMENTS

Figure 1:
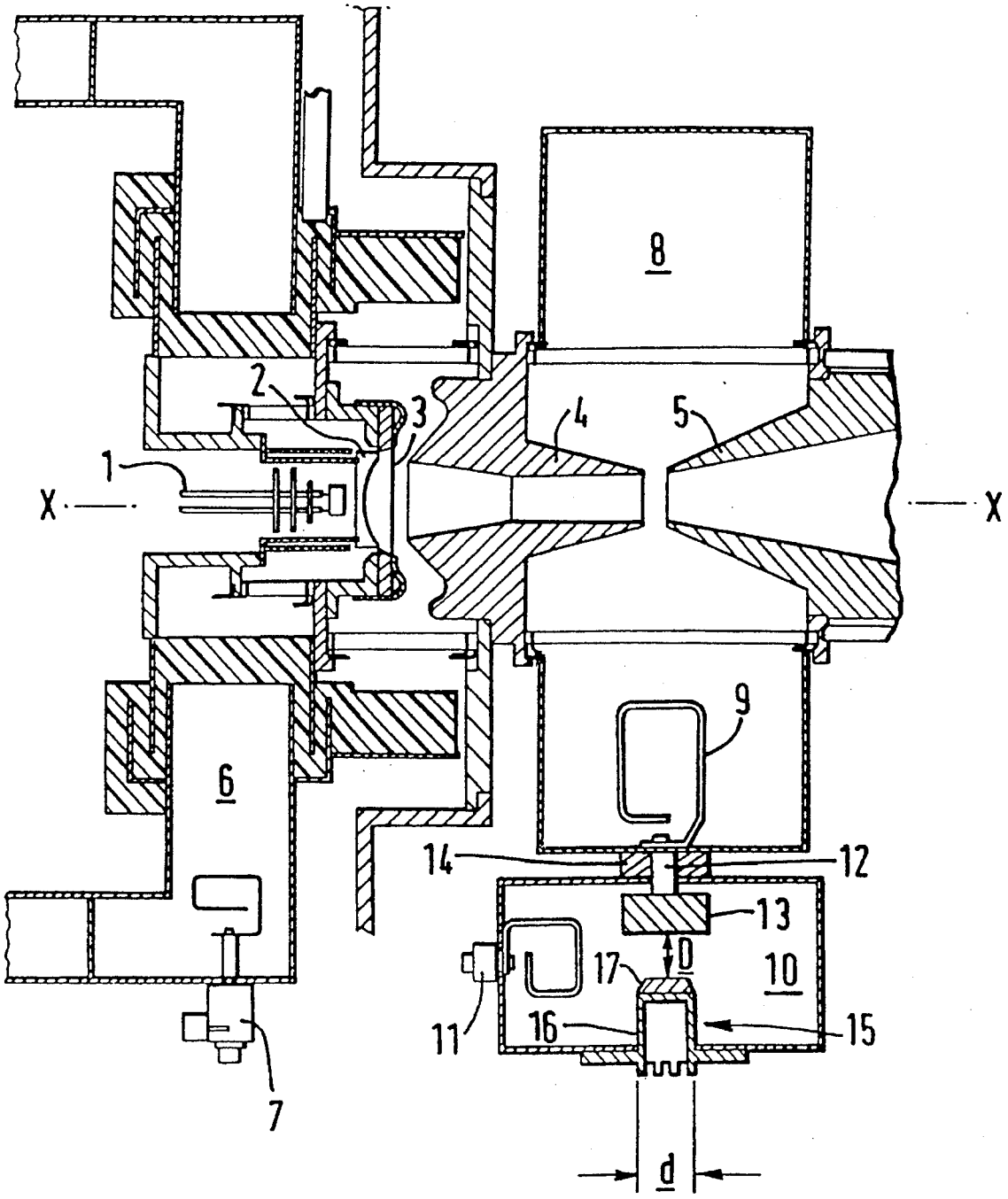
FIG. 1 schematically illustrates an IOT comprising a coupling dome configuration in accordance with the invention.

With reference to FIG. 1, an IOT comprises an electron gun 1 which includes a cathode 2 and grid 3 arranged to produce a linear electron beam along the longitudinal axis X—X of the arrangement. The IOT includes drift tubes 4 and 5 via which the electron beam passes before being collected by a collector (not shown). A cylindrical input resonant cavity 6 is arranged coaxially about the electron gun 1 and includes an input coupling 7 at which an r.f. signal to be amplified is applied. A primary output cavity 8 surrounds the drift tubes 4 and 5 and includes a coupling loop 9 via which an amplified r.f. signal is extracted and coupled into a secondary output cavity 10 and from the IOT via an output coupling 11.

During operation of the device, the cathode 2 and the grid 3 are maintained at potentials of the order of 30 kV, the grid 3 being maintained at a dc bias voltage of about 100 volts less than the cathode potential. The input high frequency signal applied at input coupling 7 results in an r.f. voltage of a few hundred volts introduced between the cathode 2 and the grid 3 to produce modulation of the electron beam.

The coupling loop 9 in the primary cavity 8 is connected via a conductive post 12 to a cylindrical block 13 which is also electrically conductive. The conductive post 12 is surrounded by insulating material 14 and is rotatable to permit the orientation of the loop 9 to be changed, thus altering the coupling between the primary and secondary cavities 8 and 10.

A coupling dome indicated generally at 15 is located in one of the walls of the secondary cavity 10 and is arranged opposite the conductive block 13. The coupling dome 15 is electrically conductive and comprises a base portion 16 which is a cylindrical flanged member mounted to project into the cavity 10. A dome completion member 17 is fixed to the end of the base portion 16 so that it faces the block 13. The dimensions of the completion member 17 are such that a particular desired gap of spacing D exists between the conductive block 13 and the dome 15. The dome completion member 17 is generally circularly cylindrical in configuration and has a diameter d which, in combination with the spacing D provides efficient coupling between the primary and secondary cavities 8 and 10.

Figure 2:
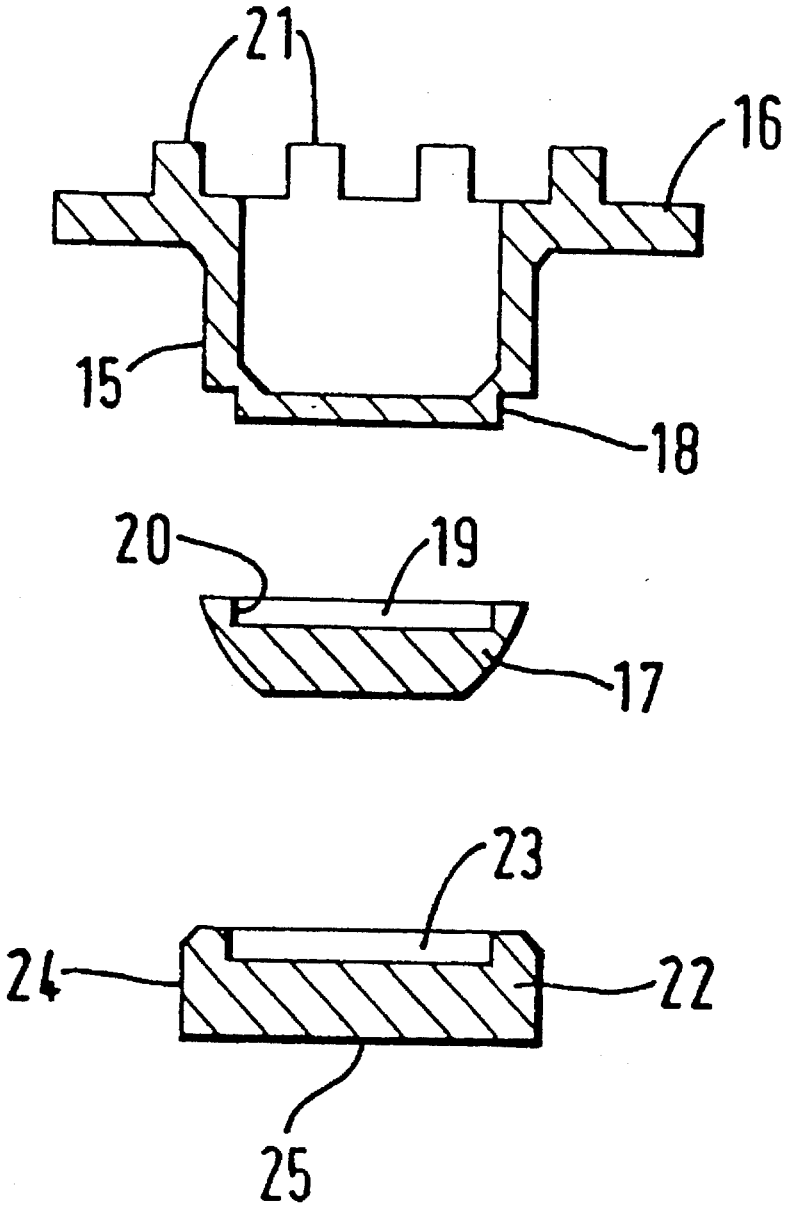
FIG. 2 schematically illustrates the coupling dome of FIG. 1 including alternative dome completion members fastened to a base portion of the coupling dome by fastening means including threads.

FIG. 2 illustrates parts of the dome 15 in greater detail. The base portion 16 includes a region of reduced width at the end which, in use, is remote from the wall of the secondary cavity. In this embodiment, the outer surface of the region of reduced width includes a screw thread 18. The dome completion member 17, shown separately, includes a cylindrical cavity 19, the side wall of which includes a screw thread 20 which cooperates with the thread 18 of the base portion 16. Thus, in order to utilise this particular dome completion member, it is simply screwed into position onto the base portion 16. The base portion 16 also includes fins 21 which extend outwardly or externally of the secondary cavity 10 (see FIG. 1) and over which cooling air flows during operation of the device.

If it is desired to use the IOT over a different range of operating frequencies, the coupling dome 15 is removed from the secondary cavity 10 (see FIG. 1). The dome completion member 17 is then unscrewed from the base portion 16 and replaced by another dome completion member 22, also shown in FIG. 2. Dome completion member 22 includes a cavity 23 which is configured to cooperate with the base portion 16 and the thread 18 so that together a coupling dome of larger diameter and greater depth is assembled. The configuration of the dome completion member 22 differs from that of the first member 17 in that its side walls 24 are substantially normal to the end face 25. As can be seen, the side walls of the first member 17 are generally curved.

When the second member 22 is added to the base member 16, the completed dome is inserted into the secondary cavity 10 (see FIG. 1) and because of the change in configuration and dimensions permits efficient coupling to be achieved over a different range of frequencies compared to that obtained with the first dome completion member 17.

Figure 3:
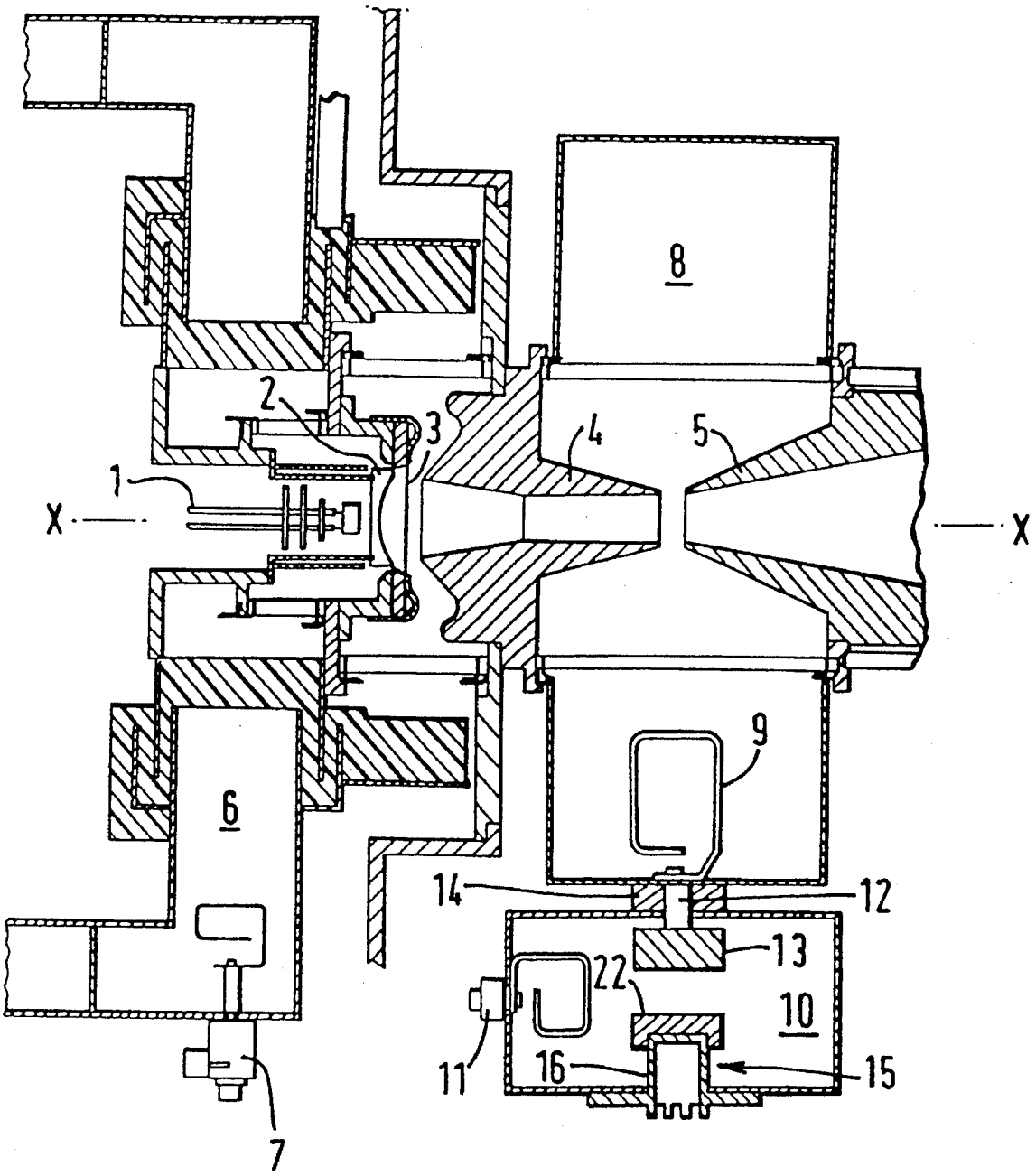
FIG. 3 illustrates the arrangement of FIG. 1 with a different dome completion member.

FIG. 3 illustrates schematically the IOT of FIG. 1 in which the first dome completion member 17 has been replaced by the second one 22. Identical reference numerals present in FIGS. 1 and 3 refer to identical parts as previously described in connection with FIG. 1.

The coupling dome as shown in FIGS. 1 and 3 is at particular specified distances from the end face of the conductive block 13 depending on which completion member is used. The particular configuration chosen is dependent on the applications and the frequencies involved. In some arrangements the gap between the end face of the dome and the block, or other conductive portion such as a wall if a block is not included, may be the same for different dome completion members In other arrangements, the gap may be different for alternative completion members.

The coupling dome of FIG. 2 is shown with two alternative end members to form the complete dome. However, a larger number of such completion members may be included in a set supplied with a particular IOT or other device to enable the user to choose between them depending on his requirements.

The coupling dome illustrated in FIG. 2 has a base portion and end portions, or dome completion members which are connected by a screw thread fitting. However, other fastenings may be employed. For example, as shown in FIG. 4, the alternative dome completion members are attached by fastenings 26 and 27 passing through the base portion and fixing the end completion members thereto.

In the arrangements so far described with reference to the previous FIGS. 1–4, the coupling dome consists of a base portion to which appropriate dome completion members are attached. FIG. 5 schematically illustrates an alternative arrangement in which a coupling dome comprises a base portion 28 which in itself effectively acts as a complete coupling dome over a certain range of frequencies without the need to add completion members. The base portion 28 is adapted to receive an additional end dome completion member 29 when operation is required over a different range of frequencies. Again, several end members may be supplied as a set for use with the base portion 28.

As seen particularly in FIGS. 4 and 5, the end dome completion members may define respective completion member cavities which are configured to receive the base portion therein.

In the illustrated arrangements, the coupling dome is located opposite a conductive block, and both the coupling dome and the conductive block are located within the secondary output cavity. In other arrangements, the conductive block may be omitted and other forms of coupling may be employed. For example, the coupling loop 9 within the primary cavity 8 may be connected to a second coupling loop within the secondary output cavity 10.

Figure 6:
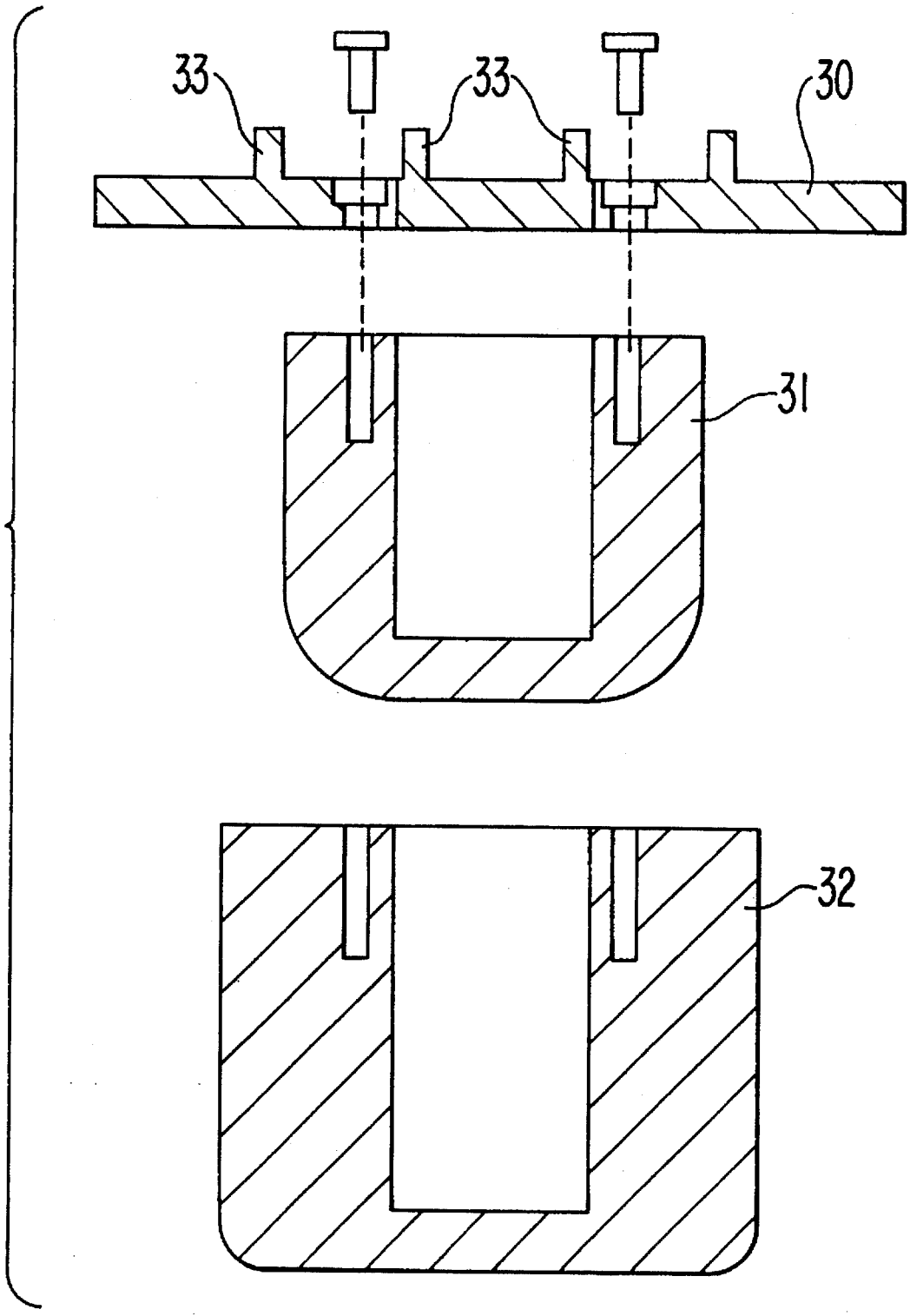
FIG. 6 schematically illustrates a coupling dome having a planar base portion and alternative dome completion members.

With reference to FIG. 6, in another arrangement in accordance with the invention, a coupling dome comprises a base portion 30 and several alternative dome completion members, two of which 31 and 32 are illustrated. In this arrangement, the base portion 30 is a substantially planar disc having cooling fins 33 projecting from one surface which in use is external to the cavity in which the coupling dome is arranged to project. The completion members 31 and 32 are fixed to the base portion 30 by screws but other fixation means could be employed. For example, the base portion could include a threaded cylindrical wall of relatively small axial extent with which the dome completion members are adapted to co-operate.

In the embodiment shown in FIG. 6, the dome completion members are hollow to save weight and reduce material requirements. However, they could be solid in other embodiments of the invention.

I claim:

1. An electron beam tube arrangement comprising:

an electron gun for emitting an electron beam for reception by a collector;

an input means operatively associated with the electron gun for applying a high frequency input signal to interact with the electron beam thereby producing a modulated electron beam;

a resonant cavity circuit defining a first cavity and a second cavity and disposed for allowing the modulated electron beam to pass through the first cavity;

means operatively associated with the resonant cavity circuit for coupling high frequency energy from the first cavity to the second cavity and including a coupling dome projecting into the second cavity from a wall of the second cavity;

means operatively associated with the second cavity for extracting high frequency output signals from the second cavity; and at least one dome completion member adapted for connection in the second cavity;

said coupling dome including a base portion having means adapted to connect a selected dome completion member to the base portion for adjusting the coupling level between the first cavity and the second cavity.

2. The arrangement according to claim 1, wherein the at least one dome completion member defines a respective completion member cavity configured to receive the base portion therein.

3. The arrangement according to claim 1, wherein the output means is an output circuit.

4. The arrangement according to claim 1, wherein the base portion is removably securable to the wall of the second cavity.

5. The arrangement according to claim 1, wherein the base portion includes a flange portion thereon disposed outside of the second cavity and adjacent the wall thereof.

6. The arrangement according to claim 1, wherein the wall of the second cavity is a first wall, the means for coupling further comprising an electrically conductive member located in the second cavity and projecting into the second cavity from a second wall thereof located opposite the first wall thereof.

7. The arrangement according to claim 6, wherein:

the at least one dome completion member includes a plurality of dome completion members; and the electrically conductive member is spaced from the coupling dome and thereby defines a gap therebetween, the respective dome completion members being configured for effecting a change in dimension of the gap by being selectively connectable to the base portion.

8. The arrangement according to claim 6, wherein:

the coupling dome has an end face disposed remote from the first wall of the second cavity, the end face being substantially flat and defining a first plane; and the conductive member is a block having a substantially flat surface defining a second plane substantially parallel to the first plane.

9. The arrangement according to claim 1, wherein the coupling dome has an end face disposed remote from the wall of the second cavity, the end face being substantially flat.

10. The arrangement according to claim 1, wherein:

the means adapted to connect includes screw threads disposed on the base portion; and the coupling dome further includes screws adapted to be disposed on the selected dome completion member for cooperating with the screw threads on the base portion for effecting a connection between the selected dome completion member and the base portion.

11. The arrangement according to claim 1, wherein the coupling dome further includes fixing means adapted to pass through the base portion and into the selected dome completion member for effecting a connection between the selected dome completion member and the base portion.

12. The arrangement according to claim 1, wherein the base portion is configured to cooperate in coupling high frequency energy between the first cavity and the second cavity without a selected dome completion member being connected thereto.

13. The arrangement according to claim 1, wherein the base portion is substantially planar.

14. The arrangement according to claim 1, wherein the coupling dome is substantially circularly cylindrical.

* * * * *